US005333820A

United States Patent [19]

Gilcher

[11] Patent Number: 5,333,820

[45] Date of Patent: Aug. 2, 1994

[54] RAILWAY VEHICLE WHEEL DETECTOR UTILIZING MAGNETIC DIFFERENTIAL BRIDGE

[75] Inventor: Heinz Gilcher, Export, Pa.

[73] Assignee: Union Switch & Signal Inc., Pittsburgh, Pa.

[21] Appl. No.: 19,019

[22] Filed: Feb. 18, 1993

[51] Int. Cl.[5] ..... B61L 13/04

[52] U.S. Cl. ..... 246/249; 324/179; 246/122 R

[58] Field of Search ..... 246/246, 247, 249, 122 R; 324/179, 207.17, 207.19

[56] References Cited

U.S. PATENT DOCUMENTS

| | | | |
|---|---|---|---|
| 2,045,923 | 6/1936 | Reichard | 246/249 |
| 3,210,539 | 10/1965 | Malaquin | 246/122 R X |
| 3,395,341 | 7/1968 | Malaquin | 324/179 |
| 3,573,441 | 4/1971 | Glazar | 246/249 X |
| 3,697,745 | 10/1972 | Bolton | 324/207.17 X |
| 3,721,821 | 3/1973 | Blanyer | 246/249 |
| 3,721,859 | 3/1973 | Blanyer | 324/179 X |
| 4,200,855 | 4/1980 | Gilcher | 338/5 |
| 4,200,856 | 4/1980 | Gilcher | 338/5 |
| 4,283,031 | 8/1981 | Finch | 246/247 X |
| 4,379,330 | 4/1983 | Sanville | 246/249 |
| 4,727,372 | 2/1988 | Buttemer | 246/247 X |

FOREIGN PATENT DOCUMENTS

| | | | |
|---|---|---|---|
| 0340660 | 11/1989 | European Pat. Off. | 246/249 |
| 3218541 | 11/1983 | Fed. Rep. of Germany | 246/247 |
| 3402349 | 7/1985 | Fed. Rep. of Germany | 246/249 |
| 0263032 | 12/1988 | Fed. Rep. of Germany | 246/249 |
| 1530409 | 10/1969 | France | 246/249 |

OTHER PUBLICATIONS

Siemens Company, *Az S 350 Microcomputer Axle Counting System for Track Vacancy Detection*, dated Jan., 1993.

Union Switch & Signal, Inc., *RSE Catalog*, Section RSE-8H2, pp. 1-4, dated Sep., 1984.

Siemens Company, *Single Magnetic Wheel Detector* phamphlet, cover page, title page, pp. 8-11, figures 1 thru 10, dated Nov., 1979.

Westinghouse Air Brake Company (Union Switch & Signal Division), *RSE Catalog*, RSE-8H1, pp. 1-3, dated Oct., 1972.

*Primary Examiner*—Michael S. Huppert
*Assistant Examiner*—Scott L. Lowe
*Attorney, Agent, or Firm*—Buchanan Ingersoll

[57] ABSTRACT

A differential magnetic wheel detector is disclosed which identifies the presence and direction of a railway vehicle. The wheel detector includes a primary winding, a secondary winding and signal processing circuitry. The primary winding is excited by a source of AC energy to produce a magnetic flux in the wheel of the railway vehicle. The secondary winding senses a change in voltage induced by the magnetic flux in the railway wheel. The secondary winding includes two coils in a differential bridge which prevents external factors from interfering with the sensing of the wheel. The signal processing device transforms the voltage change into a signal identifying the presence and direction of the railway vehicle.

16 Claims, 4 Drawing Sheets

RAILWAY VEHICLE WHEEL DETECTOR UTILIZING MAGNETIC DIFFERENTIAL BRIDGE

1. FIELD OF THE INVENTION

This invention relates to a device and method for detecting the presence, speed and direction of movement of a railway vehicle. More particularly, this invention concerns a wheel detection device having a transmitter coil and two receiver coils where the receiver coils are in the form of a differential bridge configuration.

2. BACKGROUND OF THE INVENTION

Many railway operations require knowledge of the position and direction of railway vehicles. Routing of railway vehicles from one destination to another requires knowledge of the position of the railway vehicles in order to develop the optimal routing system.

Often times knowledge of the accurate position of a specific railway vehicle is necessary to execute railway operations. For instance, wheel detection devices can be utilized to identify when the railway vehicle is at the correct distance such that a car retarder mechanism can be applied.

Also, it is desirable to know when the railway vehicle is in the exact position or spot where coal is to be dumped from the vehicle into a collection bin in order that no coal is spilled during the transfer from the vehicle to the bin. Only when the vehicle is known so be in the correct position should the transfer operation be initiated.

Further, bar code readers can be utilized to identify the specific railway vehicle upon which the dumping operation is done. The sensing of a railway vehicle by a detection device triggers the bar code reader positioned along the track to receive the signal of the specific railway vehicle. Then, when the detection device senses the vehicle is out of the bar code reader zone, the bar code reader may be turned off. By activating the bar code reader system when a railway vehicle is in its reading zone and deactivating the reader when there are no railway vehicles in the zone, energy can be saved.

The prior art has developed detection devices which utilize a receiver and transmitter coil configuration for sensing the presence and direction of a railway vehicle. Some of these detecting devices are subject to inaccuracies where there is an increase in temperature or where there is interference from debris located near the coils. Both of these conditions can create drift which make sensing the position and direction of the railway vehicle difficult.

Most prior art devices generally do not provide a railway detection device able to be used in the presence of the large traction propulsion current of an electrified railroad. This is because the large currents may saturate the receiver amplifier and/or coils such that it is difficult to sense the presence of the railway vehicle wheel.

Flange detectors are also used in the prior art to detect the presence of a railway vehicle. In some of these cases, she detection devices consist of a magnet and a Hall effect sensor which sense a magnetic field in the flange of a railway wheel. As in the conventional transmitter/receiver coil wheel detectors, flange detectors may not accurately detect the presence of a railway vehicle in the presence of debris or high ambient temperature. Further, a flange may break from the rest of the wheel or deteriorate due to wear. In this situation, the detection device may not sense the railway vehicle.

3. SUMMARY OF THE INVENTION

A device and method practicing the invention detects the presence and direction of movement of a railway vehicle via magnetic coupling between a primary winding means and a secondary winding means. The secondary winding means are arranged in a differential bridge configuration that effectively cancels common-mode signals such as may be caused by high temperatures, electronic noise and debris. A processing means transforms a differential voltage change induced onto the secondary winding means in the presence of a railway vehicle wheel into appropriate vehicle detection signals.

The primary winding means preferably includes a transmitter coil excited by a source of alternating current energy. This creates a magnetic transmission flux which varies in time according to a preselected frequency of the excitation current. In the absence of an adjacently traveling railway vehicle wheel, any of this transmission flux received by the secondary winding means will induce a known steady-state voltage. While this steady-state voltage level may be set to zero by precise balancing of the differential bridge, presently preferred embodiments utilize a differential bridge set to a slight imbalance so that a carrier signal is continually passed to the processing means.

When a railway vehicle wheel is traveling adjacent the primary winding means, the transmission flux produces eddy currents in the wheel. These eddy currents generate a magnetic detection flux which induces a change in the output level of the differential bridge. As such, the modulation envelope of the carrier signal contains information indicative of the presence and direction of the vehicle.

In presently preferred embodiments, the processing means preferably includes an amplifier, a demodulator, a level detector and logic circuit means. The amplifier receives a relatively weak voltage change signal from the differential bridge and produces a more usable amplified signal. Additionally, the amplifier may include a band-pass filter generally tuned to the frequency of the carrier signal to suppress any undesirable noise which may be present in this voltage change signal. The demodulator rectifies the amplifier output and removes the carrier signal such that the output due to vehicle presence can be identified more clearly. The level detector receives the output of the demodulator and produces first and senora level detector signals. The sequence of these level detector signals indicates whether the railway vehicle is traveling in a forward or a reverse direction. Logic circuit means receive the level detector signals and produce a first output signal at a first output terminal if the vehicle is traveling in a forward direction and a second output terminal signal at a second output if the vehicle is traveling in a reverse direction.

The invention further provides for precise measurement of the position of the wheel. For example, the receiver coils positioned generally six inches apart and sensing when the wheel is moving over respective receiver coils of the secondary winding means enables the position of the wheel to be determined within six inches. Moreover, knowing the transmitter coil is positioned at the midpoint of the receiver coils, the level detector outputs and the logic circuit means outputs can be examined to determine the position of the wheel.

All of the detection device circuitry can be located within a channel member, thus providing for minimal chance of physical damage to the circuitry. Having the receiver coils and the transmitter coils positioned inside the channel member may prevent damage from external factors such as inclement weather, exposure to the train, impact from tools used for the maintenance of the rail.

The invention provides for a more cost effective, easily manufactured wheel detection device for railway vehicles.

4. BRIEF DESCRIPTION OF THE DRAWINGS

Other details, objects and advantages of the invention will become more readily apparent as the following description of a presently preferred embodiment thereof proceeds.

The accompanying drawings show a presently preferred embodiment of the invention in which.

5. DETAILED DESCRIPTION OF PRESENTLY PREFERRED EMBODIMENTS

Figure 1:
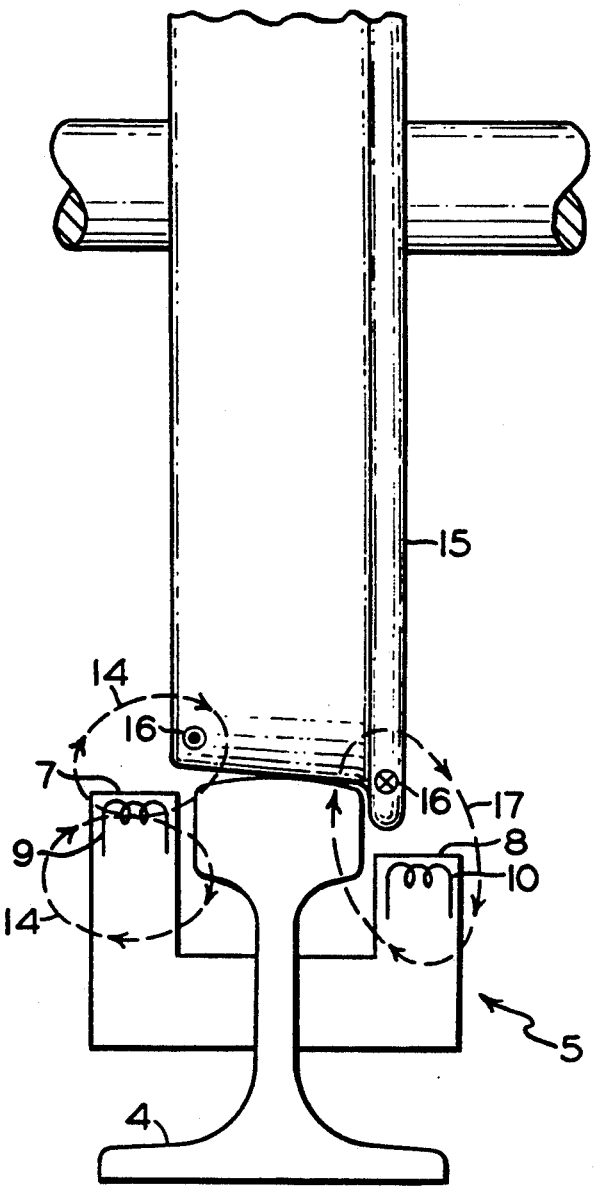
FIG. 1 is a partial vertical sectional view of the preferred embodiment of the differential magnetic wheel detector.
Figure 3:
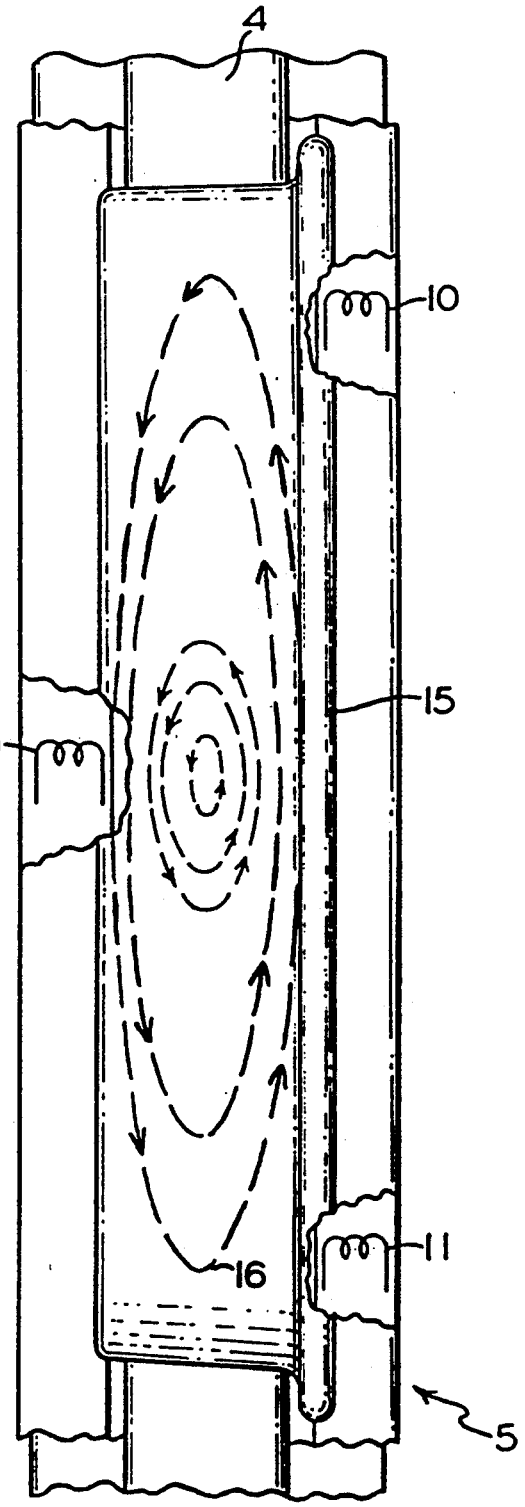
FIG. 3 is a top view of FIG. 1 with the transmitter and receiver coils shown in a cut away view of the channel member.
Figure 2:
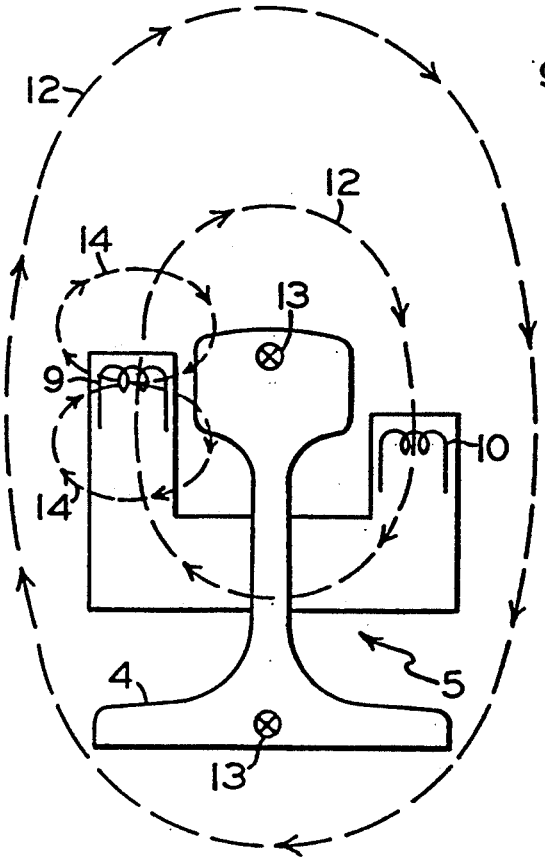
FIG. 2 is a vertical sectional view of a rail having a channel member.

Referring now to the drawings, FIGS. 1-3 show an elongated rail 4 having mounted thereto a magnetic wheel detector 5 constructed in accordance with the invention. Unlike many prior art wheel detectors, detector 5 is well-suited for use both in electrified and non-electrified territory. Furthermore, the invention is less affected by common-mode influences such as mechanical stress, temperature variation and debris than prior art detectors.

Detector 5 generally comprises a first leg member 7 and a second member 8 which are respectively mounted to opposite sides of the web section of rail 4 in a conventional manner. When mounted as shown, first leg member 7 and second leg member 8 together form a U-shaped channel which extends a certain longitudinal distance along rail 4. First leg 7 contains a transmitter coil 9 which is excited by a source of alternating current energy having a preselected frequency. First and second receiver coils 10 and 11 are arranged in a differential bridge circuit and positioned in the second leg 8.

FIG. 2 illustrates prevailing conditions in the absence of a railway vehicle traveling adjacent detector 5. In this situation, magnetic flux 12 produced by traction current 13 moving through rail 4 will have a generally equal effect on coils 10 ant 11. Additionally, a minimal amount of transmission flux 14 produced by transmitter coil 9 will be received at receiver coils 10 and 11. Because coils 10 and 11 are arranged in a differential bridge, such common-mode signals received by both will tend to be nulled.

As can best be seen in FIGS. 1 and 3, a wheel 15 moving along rail 4 acts as a conductor of magnetic flux produced by the transmitter coil 9. As a result, eddy currents 16 are produced in wheel 15. Eddy currents 16 then induce a magnetic detection flux 17 (see FIG. 1) which may extend between the wheel 15 and receiver coils 10 and 11.

FIG. 3 also shows the eddy currents 16 produced by transmitter coil 9 during the movement of wheel 15 over rail 4. As can be seen, transmitter coil 9 is preferably positioned at the midpoint with respect to the positions of receiver coils 10 and 11. In presently preferred embodiments, receiver coils 10 and 11 are spaced approximately six inches apart along second leg 8.

Figure 4:
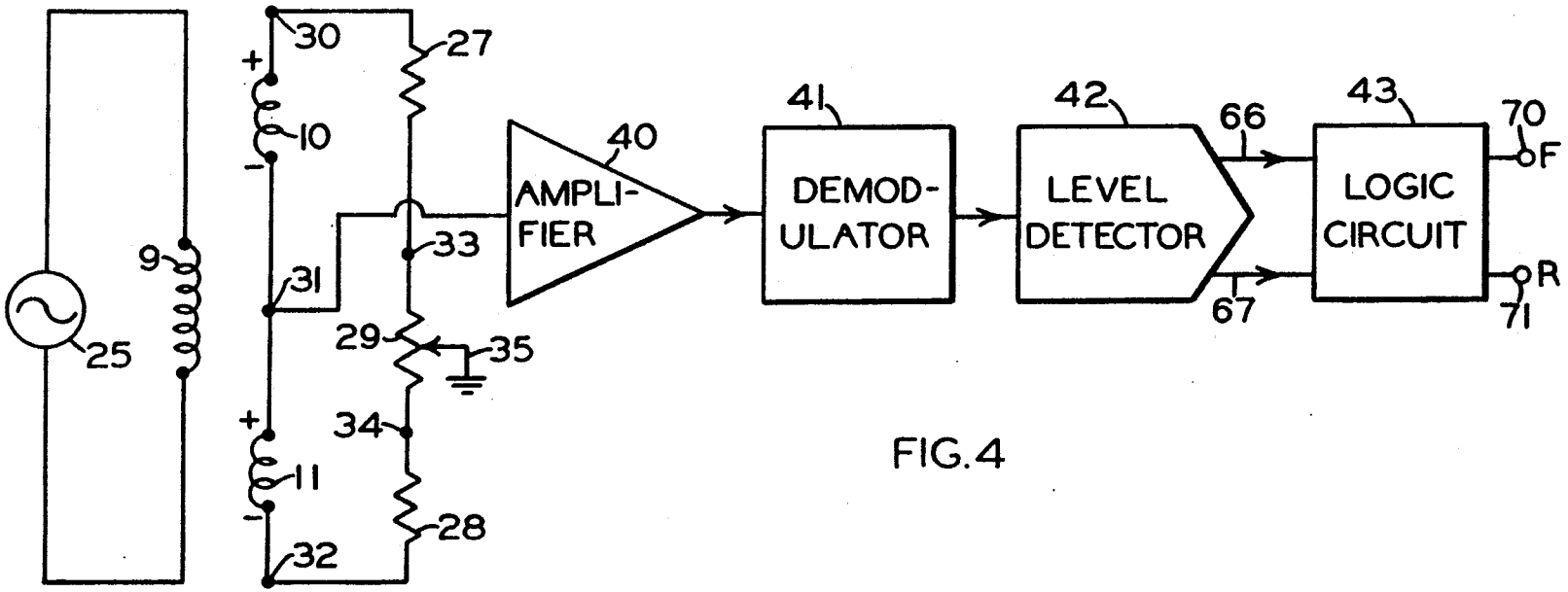
FIG. 4 is a schematic diagram of the electronic circuitry of the presently preferred embodiment of the differential magnetic wheel detector.

The electrical circuitry of wheel detector 5 is illustrated in better detail in FIG. 4. As shown, transmitter coil 9 is excited by alternating current energy from AC power supply 25. Supply 25 may be contained within first leg member 7 or may represent a pre-existing supply source such as may me found in many railway installations. In presently preferred embodiments, supply 25 provides transmitter coil 9 with alternating current having a preselected frequency of approximately 7.5 kilohertz (KHz), although other appropriate frequencies may also be used.

The secondary winding means comprises a differential bridge configuration to minimize inaccuracies which may be caused by various common mode Influences Generally, the bridge includes coils 10 and 11 as well as resistors 27 and 28. As will be explained more fully below, presently preferred embodiments also utilize a potentiometer 29. Preferably, the respective inductances of coils 10 and 11 are generally, equivalent as are the resistances of resistors 27 and 28. In other embodiments it may be preferable to use various values for coil inductances and circuit resistances.

The differential bridge configured as shown in FIG. 4 is thus a six terminal electrical network. Specifically, first receiver coil 10 is connected between terminals 30 and Second receiver coil 11 is connected between terminals 31 and 32. Resistor 27 is connected between terminals 30 and 33. Resistor 28 is similarly connected between terminals 32 and 34. Finally, potentiometer 29 is connected between terminals 33 and 34 and has an adjustable terminal 35 connected to a ground reference.

Because coils 10 and 11 are connected together at terminal 31 with opposite polarities, a rise in voltage across one due to a common-mode influence will be accompanied by a generally equivalent fall in voltage across the other. As such, the voltage level at this terminal resulting from such common mode influences will tend to remain constant. In fact, balance in the bridge configuration would result in an output level of generally zero volts at terminal 31 due to common-mode influences. In some preferred embodiments it will be desirable, however that the bridge be adjusted to a slight imbalance using potentiometer 29. In this way, a carrier signal having a preselected steady-state level will be maintained at terminal 31. The frequency of the carrier will be that of the alternating current exciting transmitter coil 9. In the presence of wheel 15, this carrier signal will experience certain changes in its modulation envelope which can be interpreted by the processing means to detect the presence and direction of the railway vehicle. This effect can be understood with continuing reference to FIG. 4 and reference to FIGS. 5A-5F as indicated.

Figure 5A:
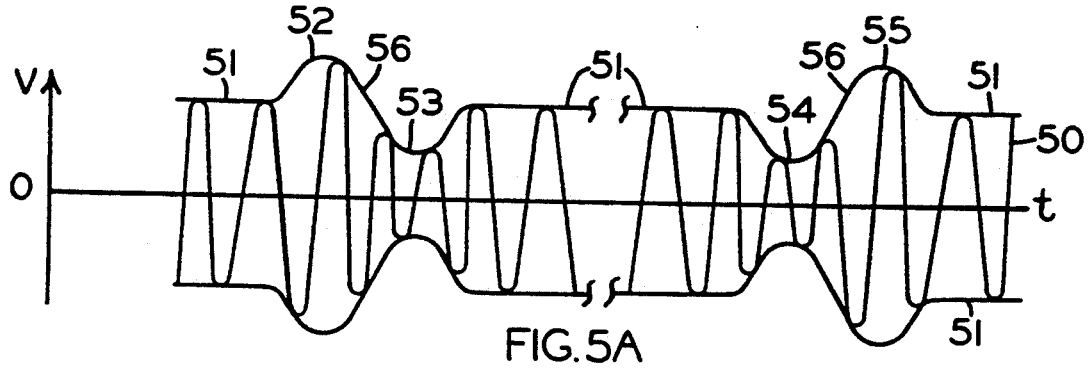
FIG. 5A illustrates the output from the band-pass amplifier of FIG. 4 in the form of a graph charting voltage vs. time.

In presently preferred embodiments, the processing means of the invention includes amplifier 40, demodulator 41, level detector 42 and logic circuit 43. Voltage changes appearing at terminal 31 are first passed to amplifier 40. Amplifier 40 preferably includes a bandpass filter tuned to the carrier signal frequency to suppress interference or other extraneous signals which may appear at level terminal 31. As shown in FIG. 5A, the output of amplifier 40 is an amplified carrier signal 50 which exhibits various amplitudes under different conditions. When no wheel 15 is travelling adjacent detector 5, signal 50 maintains a steady-state level 51. Movement of wheel 15, however, adjacent detector 5 will cause the amplitude of signal 50 to peak and trough in a manner that can be used to determine the railway vehicle's direction of movement.

Referring to the left part of FIG. 5A, a forward movement of wheel 15 is illustrated. As wheel 15 travels adjacent first receiver coil 10, signal 50 experiences a peak 52 in amplitude. Further movement of wheel 15 past second receiver coil 11 causes the amplitude of signal 50 to experience a trough 53. The right part of FIG. 5A reveals reverse movement of wheel 15 past detector 5. Specifically, as wheel 15 travels adjacent second receiver coil 11, signal 50 experiences a trough 54 in amplitude. As wheel 15 further travels past first receiver coil 10, carrier signal 50 exhibits a peak 55 in its modulation envelope. When wheel 15 is in a position generally equidistant between receiver coils 10 and 11, the amplitude of signal 50 will tend to a null level 56 and then either rise when moving toward the first receiver coil 10 or fall when moving toward second receiver coil 11.

Figure 5B:
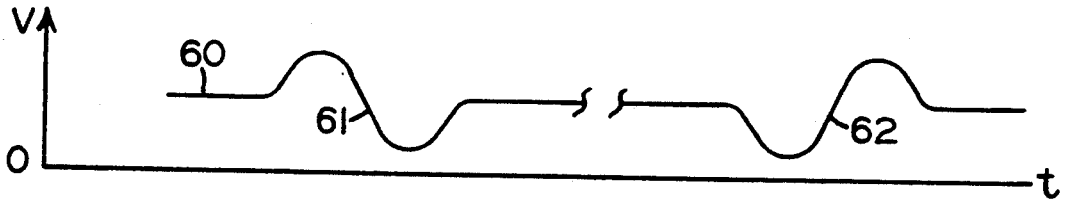
FIG. 5B illustrates the output from the demodulator of FIG. 4 in the form of a graph charting voltage vs. time.

As shown in FIG. 5B, demodulator 41 removes carrier signal 50, producing a demodulated signal 60 corresponding so the positive voltage levels of the modulation envelope. In other words, signal 60 represents the various peak amplitude levels of carrier 50 during conditions when a railway vehicle is or is not present. Specifically variation patterns 61 and 62 indicate vehicle movement in the forward and reverse directions, respectively. As a result, the information concerning the direction of movement of the vehicle is retained in the demodulation operation.

Figure 5C:
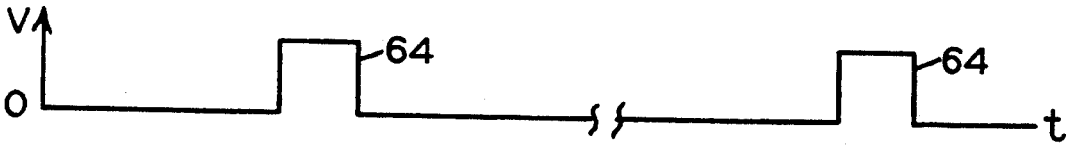
FIGS. 5C and 5D illustrate output signals at the respective outputs of the level detector of FIG. 4 in the form of a graph charting voltage vs. time.
Figure 5D:
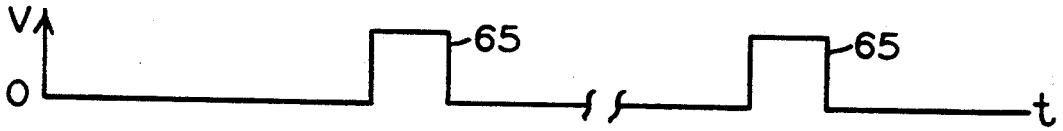
Figure 5E:
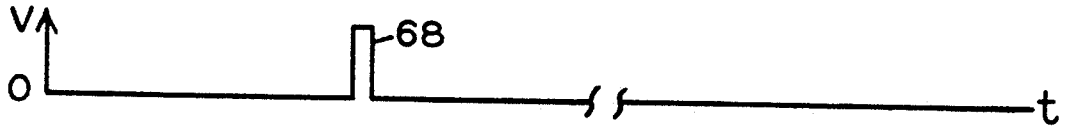
FIGS. 5E and 5F illustrate output signals at the respective output terminals of the logic circuitry of FIG. 4 in the form of a graph charting voltage vs. time.
Figure 5F:
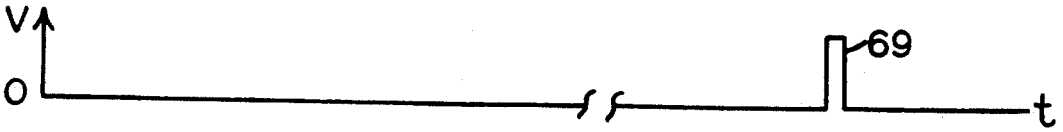

Referring to FIGS. 5C and 5D, the output of demodulator 41 is then fed through level detector 42 which preferably produces two separate level detector output signals 64 and 65 at respective outputs 66 and 67. Signal 64 corresponds to a rise in the level of signal 60. Signal 65, on the other hand, indicates a fall in the level of signal 60. The sequence in which signals 64 and 65 are generated thus indicates the direction in which the railway vehicle is moving. Specifically, the occurrence of signal 64 before signal 65 indicates forward movement. Reverse movement is similarly indicated by the occurrence of signal 65 before signal 64. Signals 64 and 65 are then processed by logic circuit 43.

Logic circuit 43 compares signals 64 and 65 and produces narrow pulse signals 68 and 69 at output terminals 70 and 71, respectively. Preferably, the pulse width of signals 68 and 69 is equal to the elapsed time between the falling edge of the first to occur of signals 64 and 65 and the rising edge of the second of these signals to occur. Narrow pulse signals 68 and 69 thus reveal when wheel 15 is generally at the midpoint of the length between first and second receiver coils 10 and 11. Signal 68 indicates wheel 15 is moving in the forward direction from the first receiver coil 10 to the second receiver coil 11, while signal 69 indicates reverse movement of wheel 15 from the second receiver coil 11 to the first receiver coil 10.

The differential magnetic wheel detector described herein can be utilized in many railway operations where it is necessary to determine the presence and/or the direction of a railway vehicle without inaccuracies attributed to electronic circuitry exposed to high temperature, debris, and harsh elements. Particularly, the differential magnetic wheel detector may be utilized in an electrified as well as a mechanically driven railroad systems. Additionally, the wheel detector can be utilized in the railway operations of routing, braking, dumping of cargo and any process involving tag reading systems in order to save energy.

While a presently preferred embodiment of the invention has been shown and described herein, it is distinctly understood that the invention is not limited thereto but may be otherwise variously embodied within the spirit and scope of the following claims.

I claim:

1. A railway vehicle detector device for sensing a passing railway vehicle wheel traveling along an elongated rail, said device comprising:

(a) means for supplying alternating current energy having a preselected frequency;

(b) primary winding means excitable by said alternating current energy for producing a time-varying magnetic transmission flux;

(c) secondary winding means including first and second receiver coils arranged in a differential bridge configuration for producing a differential voltage change as said wheel is traveling adjacent said detector due to a magnetic coupling with said primary winding means; and (d) processing means for receiving said differential voltage change and responsively producing an output signal indicative of the presence and direction of movement of said wheel.

2. The railway vehicle detector device of claim 1 wherein said primary winding means includes a transmitter coil and wherein said first and second receiver coils are connected together with opposite polarities such that a common-mode voltage increase in one of said receiver coils is generally offset by a common-mode voltage decrease in another of said receiver coils.

3. The railway vehicle detector device of claim 2 wherein said differential bridge configuration comprises a multiple terminal electrical network including:

said first receiver coil being connected between a first and a second network terminal;

said second receiver coil being connected between said second and a third network terminal;

a first resistor connected between said third and a fourth network terminal;

a second resistor connected between said first aria a fifth network terminal;

a potentiometer connected between said fourth and said fifth network terminal and further having an adjustable terminal connected to a ground reference; and said second network terminal being a bridge output terminal at which said differential voltage change may be detected.

4. The railway vehicle detector device of claim 3 wherein said potentiometer is selectively adjusted such that said transmission flux will produce at said second network terminal a carrier signal at said preselected frequency, said carrier signal having a preselected steady-state peak amplitude level.

5. The railway vehicle detector device of claim 4 wherein said secondary winding means is configured having said first and second receiver coils spaced apart by a preselected longitudinal displacement along said elongated rail when mounted thereon such that presence of said wheel traveling adjacent said detector will produce variation patterns in a modulation envelope of said carrier signal.

6. The railway vehicle detector device of claim 5 wherein said secondary winding means is configured to produce a first variation pattern in said modulation envelope when said railway vehicle is traveling in a forward direction and a second variation pattern in said modulation envelope when said railway vehicle is traveling in a reverse direction.

7. The railway vehicle detector device of claim 2 wherein said primary winding means and said secondary winding means are configured for placement on respective opposite sides of said elongated rail.

8. The railway vehicle detector of claim 7 wherein said transmitter coil is positioned within a first leg member for mounting to a first side of said elongated rail and said first and second receiver coils are positioned within a second leg member for mounting to a second side of said elongated rail opposite said first side.

9. The railway vehicle detector device of claim 8 wherein said first and second receiver coils are spaced apart in said second leg member by a preselected longitudinal displacement and said transmitter coil is positioned within said first leg member to be generally equidistant from said first and second receiver coils when said detector is mounted on said elongated rail.

10. The railway vehicle detection device of claim 9 wherein said preselected longitudinal displacement is approximately six inches.

11. The railway vehicle device of claim 2 wherein said processing means includes an amplifier means for amplifying said differential voltage change.

12. The railway vehicle detection device of claim 11 wherein said amplifier means is a band-pass amplifier having a resonant frequency generally equal to said preselected frequency.

13. The railway vehicle detection device of claim 12 wherein said processing means further includes a demodulator means for separating said differential voltage change from a carrier signal at said preselected frequency.

14. The railway vehicle detection device of claim 13 wherein said processing means further includes level detection means for producing a first and a second level detector signal, said first level detector signal indicating movement of said wheel adjacent said first receiver coil and said second level detector signal indicating movement of said wheel adjacent said second receiver coil.

15. The railway vehicle detection device of claim 14 wherein said processing means further includes a logic circuit means for producing a first logic circuit output signal indicating movement of said railway vehicle in a forward direction and a second logic circuit output signal indicating movement of said railway vehicle in a reverse direction.

16. The railway vehicle detection device of claim 15 wherein said first and second logic circuit output signals are narrow pulse signals respectively having a pulse duration equivalent to an elapsed time between a falling edge of a first occurring of said first and second level detector signals and a rising edge of a second occurring of said first and second level detector signals.

* * * * *

UNITED STATES PATENT AND TRADEMARK OFFICE

CERTIFICATE OF CORRECTION

PATENT NO. : 5,333,820

DATED : August 2, 1994

INVENTOR(S) : HEINZ GILCHER

It is certified that error appears in the above-indentified patent and that said Letters Patent is hereby corrected as shown below:

On title page, item

[56] References Cited, Patent No. 1530409, change "France" to --Fed. Rep. of Germany--.

Column 6, line 63, claim 3, change "aria" to --and--.

Signed and Sealed this

Twenty-ninth Day of November, 1994

Bruce Lehman

*Attest:*

BRUCE LEHMAN

*Attesting Officer*

*Commissioner of Patents and Trademarks*